US006578237B1

(12) United States Patent
Patelli et al.

(10) Patent No.: US 6,578,237 B1
(45) Date of Patent: Jun. 17, 2003

(54) DEVICE FOR CLEANING THE GUIDES OF TRAVELLING FLATS IN A FLAT CARDING MACHINE

(75) Inventors: Silvano Patelli, Palazzolo Sull'Oglio (IT); Marco Facchinetti, Palazzolo Sull'Oglio (IT); Giovanni Battista Pasini, Palazzolo Sull'Oglio (IT)

(73) Assignee: Marzoli S.p.A., Palazzolo Sull'oglio (IT)

( * ) Notice: Subject to any disclaimer, the term of this patent is extended or adjusted under 35 U.S.C. 154(b) by 0 days.

(21) Appl. No.: 10/032,274

(22) Filed: Dec. 20, 2001

(30) Foreign Application Priority Data

Dec. 28, 2000 (IT) ..... MI00A2843

(51) Int. Cl.[7] ..... D01G 15/76
(52) U.S. Cl. ..... 19/108; 19/102; 19/111
(58) Field of Search ..... 19/98, 102, 103, 19/105, 110, 111, 113; 15/1, 22.3, 93.1, 250.24

(56) References Cited

U.S. PATENT DOCUMENTS

| | | | | | |
|---|---|---|---|---|---|
| 4,996,746 | A | * | 3/1991 | Verzilli et al. | 19/111 |
| 5,542,154 | A | * | 8/1996 | Demuth et al. | 19/114 |
| 5,749,126 | A | * | 5/1998 | Patelli et al. | 19/102 |

FOREIGN PATENT DOCUMENTS

| | | | | |
|---|---|---|---|---|
| GB | 2224043 | * | 4/1990 | D01G/15/28 |
| GB | 2266539 | * | 3/1993 | D01G/15/28 |
| IT | 0794271 | * | 9/1997 | D01G/15/28 |
| IT | 0794272 | * | 9/1997 | D01G/15/24 |

* cited by examiner

*Primary Examiner*—Gary L. Welch
(74) *Attorney, Agent, or Firm*—Hedman & Costigan, P.C.

(57) ABSTRACT

Device for cleaning the guides of travelling flats in a flat carding machine, to eliminate from these deposits of foreign material found in the carded fibrous material, consisting in fitting the travelling flats assembly with flats provided with scraping or cleaning elements which come into contact with the surfaces of the guides on which the elements on which the flats rest are pulled.

7 Claims, 4 Drawing Sheets

DEVICE FOR CLEANING THE GUIDES OF TRAVELLING FLATS IN A FLAT CARDING MACHINE

The present invention relates to flat carding machines in which a thin layer of fibrous material is processed in a plurality of stages passing between the surfaces moved by relative motion and provided with clothings of points or needles—moved by relative motion—encountering cleaning blades and suction outlets. In these stages the fibrous material in flock is opened out and purified, the smallest particles of dirt are eliminated, as are waste and tangles. During carding the fibres are homogenized to form a blend with one other; the carded product is composed of a sliver of fibres essentially paralleled, to be sent to the subsequent stages to produce yarns.

To illustrate the problems and difficulties of the carding operation, confronted in the present invention, the work of a flat carding machine is schematically described with reference to FIG. 1.

The raw material 1, composed of fibres in a layer of flock, is fed to the carding machine by a feeder roller 2 that, with the opposite board 3, supplies a wide tuft 4 to the taker-in cylinder 5, currently named "briseur". Said briseur is provided with a clothing of points, generally less dense than those of the carding cylinder, and rotates at considerable speed; the fibres of the tuft 4 are distributed on the clothing of the briseur and are roughly combed and disentangled. Along their path on the briseur, the fibres encounter fixed segments with point clothing and blades to remove impurities and then pass on to the subsequent carding cylinder 6. This carding cylinder is, in fact, operated at a higher peripheral speed than the briseur speed and its points remove the layer of fibres, at their nearest generatrices. In general, the carding cylinder 6 is provided with a denser and more minute clothing than the briseur.

The travelling flats 7 are positioned in line with the upper part of the cylinder 6. These travelling flats are bars with a useful length corresponding to the width of the cylindrical surface of the carding cylinder 6 and a few centimetres in width. The part of them that faces the clothed surface of the cylinder 6 is also provided with a clothing of points. Generally, the travelling flats move at low speed in the same or in the opposite direction to the cylinder motion, which instead moves at noteworthy speed. The respective clothings opposite one another perform the typical carding action of distending and cleaning the fibres. The peripheral speed of the cylinder generally ranges from 15 to 40 metres per second, while the speed of the flats is in the order of a few centimetres per minute.

The flats 7 thus circulate around an arc of the periphery of the cylinder 6 operated by a drive element 8, for example chains or toothed belts, which circulate in a closed circuit between a series of actuating and guiding toothed wheels 9. Along the carding path between the cylinder and the flats, the flats are guided by guides 10 that are regulated with extreme precision, to determine the reciprocal distances between the clothing of points of the cylinder and of the flats, which are essential for the efficacy and quality of processing. The guides 10 are positioned in line with the edge of the flat faces of the cylinder and are grazed by the end parts of the flats 7, not fitted with points. The distended and cleaned fibres on the carding cylinder 6 are then removed by a doffer 11 and removed from this with detaching cylinders not shown in the figure.

In the traditional art, the bodies of flats are generally made of cast ferrous material, typically cast iron, subsequently fitted with the clothing of points for carding. These traditional flats are generally driven by articulated pulling chains to which the flats are fixed, both in the articulations and plates of the chain, with elements known to the state of the art.

In order to simplify and lighten the device, more recently designed carding machines use travelling flats produced by a section bar, subsequently fitted with carding clothings. These flats, generally made from T-bars with lightening cavities, while satisfying the requirements for stability and flexural and torsional rigidity, are lighter and altogether less expensive. Generally, lighter materials, such as light aluminium alloys, are used to make these lighter flats and drive is provided with toothed belts in place of traditional metal chains.

More information on the state of the art of carding machines and travelling flats is found in the European patent application EP-A-361.219 by Truetzschler GmbH, and in the European patent application EP-A-567.747 which describes the insertion, into the ends of the carding flats, of cylindrical pins more resistant to wear to rest these on the guides 10. European patent application EP-A-627.507 by Maschinenfabrik Rieter AG describes a coupling between the carding machine flats and the toothed drive belt using the same pins to rest on the guides 10. European patent applications EP 794.271 and 794.272 in the name of the applicant, describe further systems for connecting the card to the toothed belt, envisaging the use of coupling pins between the toothed belt and the flats and separate from the pins with which the flats rest on the guides.

There is a problem with technical solutions according to prior art in that when carding on the main cylinder, noteworthy impurities accumulate caused by foreign materials contained in the flock fibre fed to the carding machine, such as sand, dust, short fibres, neps and so on. These materials produce significant deposits that stratify on the guides 10.

These deposits adhere to give rise to noteworthy problems. For example, the distance set between the clothings of the carding cylinder and of the flats is modified and influences the efficacy of processing proportional to the distance with which the flat follows the direction of the profile of the guides 10. Another problem is caused by the abrasive action that this layer of material deposited on the guides 10 exerts on the pins on which the flats rest and in particular on their generatrix in contact with the guides. Due to this wear, systematic maintenance is required on the majority of the flats to restore the pins and adjust the distances between the clothings.

The object of the present invention is to provide a system to remove the deposits of foreign material on the guides 10 with which these are essentially contrasted, if not totally eliminated.

The device according to the invention is defined in its essential components, in the first claim, while its variants and preferred embodiments are specified and defined in the dependent claims. From the exemplificative description ensuing, the travelling flats assembly activated to slide on the guides 10 is provided, in its overall development, with scraping or cleaning elements that come into contact with the surface of the guides 10, removing the deposit of foreign material from the surfaces of the guides 10, on which the elements on which the flats rest are pulled, in any case contrasting accumulation.

To illustrate the characteristics and advantages of the present invention with greater clarity, it is described with reference to some typical embodiments shown in FIGS. 2 to 6, provided as non-limiting examples.

Said figures refer to the flat/guide system according to the invention and also to various examples of embodiment of said scraping or cleaning elements, to illustrate the characteristics and benefits ensuing from the present invention. The exemplificative illustrations below refer to the model of carding machines with travelling flats driven with a toothed belt, it being specified that the present invention is not limited to the use of this type of drive element.

As already expounded,

Figure 1:
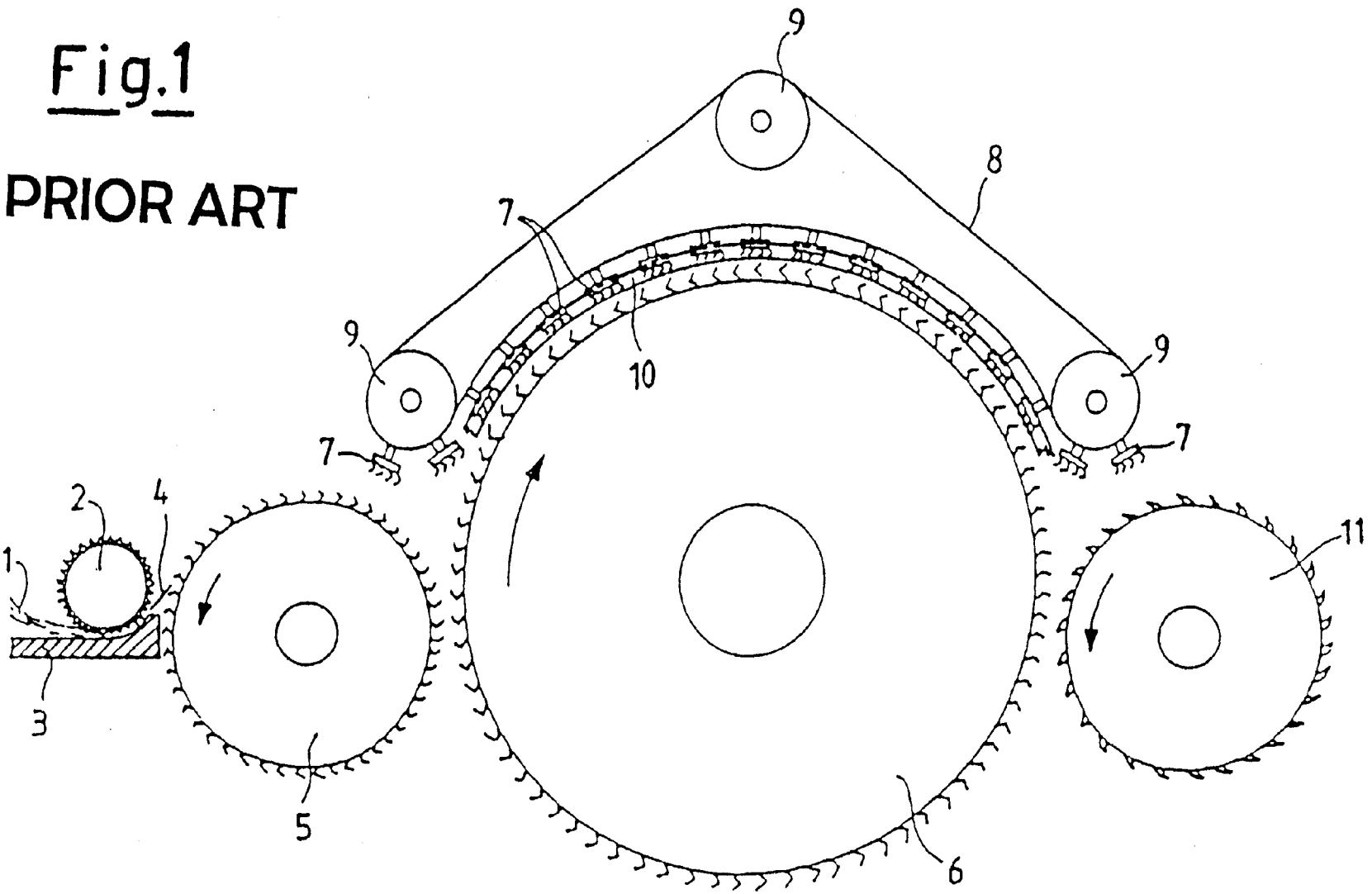
Fig.1 PRIOR ART
FIG. 1 shows the general scheme of a flat carding machine to draw attention to the requirements and problems of the carding operation.
Figure 2:
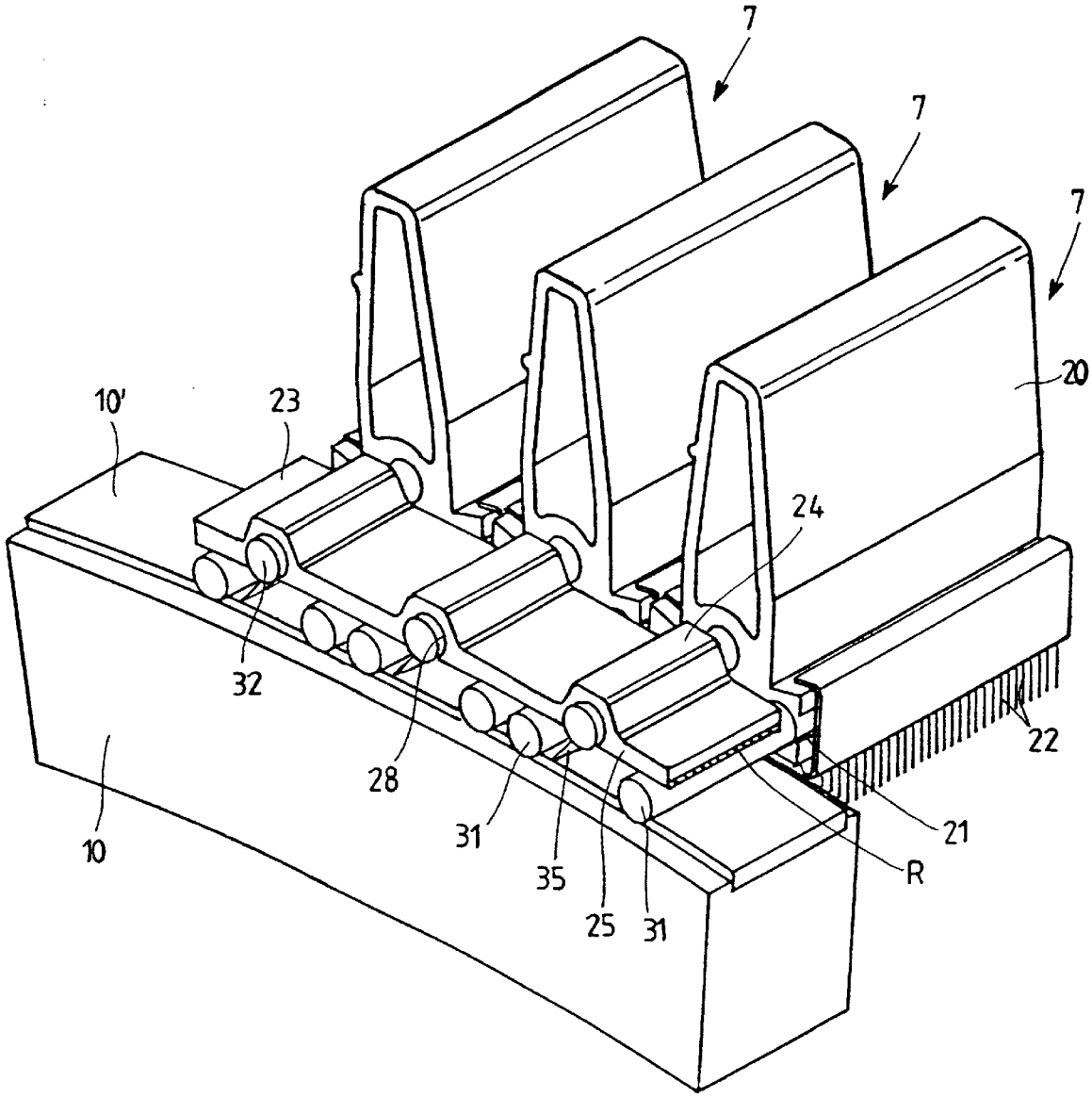
FIG. 2 shows a perspective view of a brief stretch of the flat/guide system operated by its toothed belt along its active path on the guide 10.

In FIG. 2, the flat 7 is shown in its active working path, in its typical T section overturned to provide sufficient rigidity to the flexural stresses between the two rests of the guide 10, one on the front in view and the other on the opposite side concealed. The shank 20 of the T is hollow to limit the weight, although maintaining the characteristics of rigidity. The body of the flat is typically machined from a section of indefinite length and cut to size to a length less than the distance between the guides 10. Its lower face 21 carries the carding clothing 22, indicated as a series of points.

Figure 3:
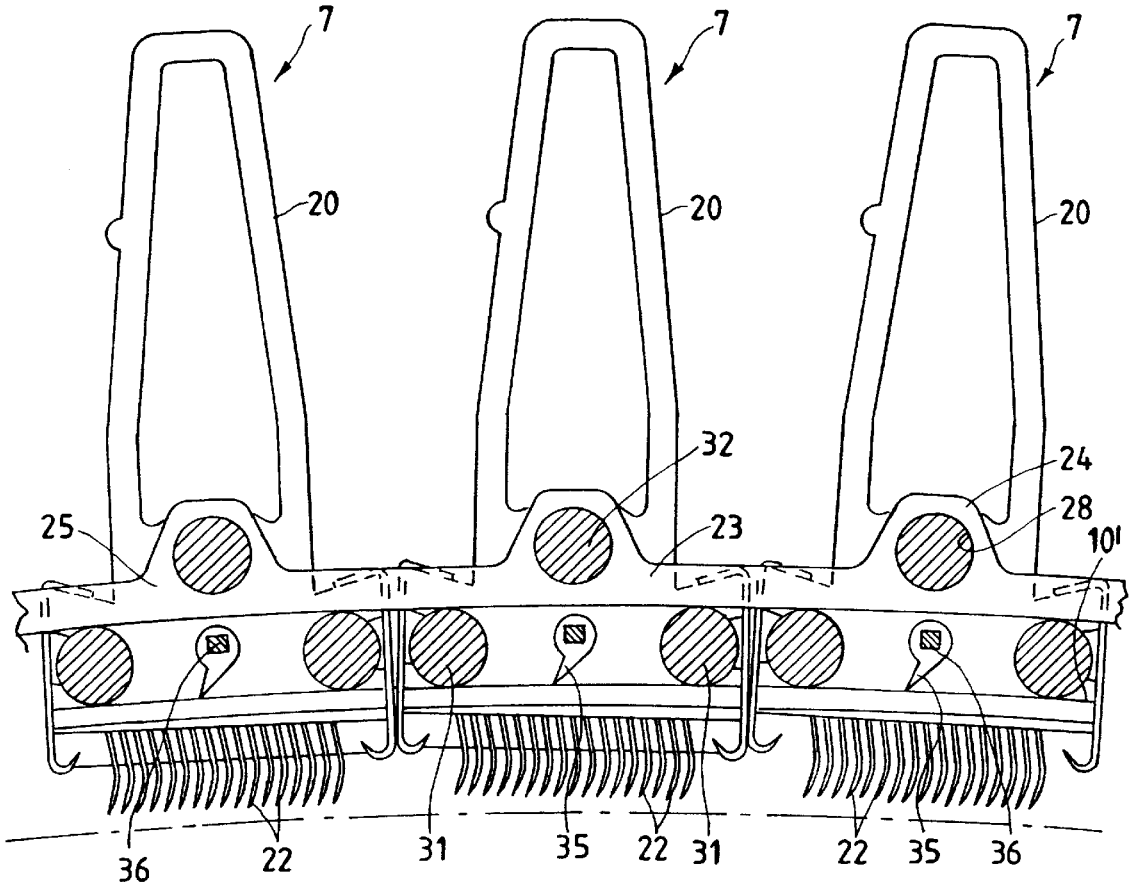
FIG. 3 shows a partially sectioned side view of the detail of the scraping element fitted to the travelling flat.

The pulling element of the flats 7 is composed of a toothed belt 23, generally made of flexible materials, for example elastomeric materials, possibly reinforced longitudinally R with textile threads and/or metal wires to limit phenomena of undesired elongation. The upper face of the toothed belt 23 has prismatic protrusions 24 or raised stretches. These protrusions 24 can act both as a body for connection with the travelling flats 7, and as toothing to engage, with their raised profile, with the toothed wheels 9 for drive and transmission. The protrusions 24 are spaced apart by a series of lower stretches 25 and—in the embodiment according to FIGS. 2 and 3—are spaced at the same distance as the pitch of the flats and also correspond to the toothing pitch of the toothed wheels 9. A cylindrical cavity 28 is machined in the body of the protrusions 24, generally with an open or closed circular section, intended to house the coupling element for the flats 7. This cylindrical cavity 28 can be closed and through or downwardly or upwardly facing, for example as described in greater detail in the aforesaid European patents EP 794.271 and 794.272 in the name of the same applicant.

On the end faces at the two ends of the body of the flats 7, and in particular on the part opposite the shank 20 and which forms the cross-member, fixed in a position nearer the face 21 are two pins 31 of wear-resistant material, for example alloy steel, oriented according to the axis of the flat and intended to slide on the guides 10 of the carding machine to support the flats 7 in their active working path with their clothings 22 facing the cylinder 6. According to an improved embodiment of the invention, the surfaces on which the guides 10 rest can be fitted with strips of coating material 10' with good sliding and wear-resistant characteristics, to reduce friction and resistance to motion of the flats 7.

Fixed to the end faces of the body of the flats 7, although in a position relatively farther from the lower face 21, is a horizontal pin 32 with a circular section intended to be inserted into one of the cavities 28 of the drive belt 23; the pin 32 has a shape and size coherent with said cavity. According to a preferred embodiment of the invention the pin 32 has a circular cylindrical section, to achieve travel of the flat 7 along its working path on the guides 10 and to allow said pin 32 freedom to adapt its rotation in relation to the cavity 28, and to allow the flat 7 to follow the profile of the guides 10 with precision.

The pins 31 to support the flat 7 on the guides 10 and 32 for coupling the flat to the belt 23 can be fixed to the body of the flat in a known manner, for example with a forced connection or with a screw connection.

A component peculiar to the system according to the present invention is composed of the scraping and cleaning elements that eliminate the accumulation of foreign material from the guides 10: these elements are fitted to the flat 7 and positioned on the external faces of the lower traverse of the flat 7 where the pins 31 and 32 are also fixed. In the exemplificative embodiment in FIGS. 2 and 3, these scraping elements are composed of blades 35 projecting from the opposite part of the protrusions 24. Typically, these blades 35 are flexible, are of a height that, with the flat 7 resting on its pins 31 on the guide 10, they essentially project below the level at which the pins 31 rest, so that they come into contact and rest with their transversal development on the surface of the guide 10 opposite them, to provide continuous scraping motion on the entire surface resting on the guide 10 of the pins 31 through the effect of the relative motion of the pulling belt 23 of the flats. According to the embodiment in FIGS. 2 and 3, these scraping blades 35 are carried by prismatic elements 36 to fix the blades and integral with the body of the flat 7, preferably in an intermediate position between the two pins 31 on which the flat rests. These elements 36 supporting the blades 35 can be fixed to the body of the flat in a known way, analogously to the pins 31 and 32. The scraping elements, with blades 35 or of another type, can be provided for all the travelling flats of the carding machine as in FIGS. 2, 3 or, alternatively, only for some of these. The flats provided with scraping or cleaning element can be distributed along the toothed belt 23 on the part that faces its guide 10, for example a scraping element every two, three or more flats.

The scraping elements can either be of the same or different types, shapes or materials. The blades 35 can rest on the guide 10 at a right, acute or obtuse angle, in order to exert a prevalently scraping action or to move the layer of impurities with its travel on the guides 10. Some of the alternative embodiments of the cleaning elements are illustrated hereinafter, in different forms from the blades. In the same travelling flats assembly provided on the flat carding machine different types of scraping/cleaning elements can be used in combination. This possibility to combine different scraping and cleaning elements also comprises elements of the same type, although differing as regards number, inclination, material and orientation, or the order in which they are fitted.

According to a preferred version of the present invention, the scraping and cleaning elements are produced and fitted so that they can be easily and inexpensively replaced after a certain period of use. The material of the cleaning elements is, in fact, selected with high wear-resistance characteristics, for example with elastomers or plastic materials with appropriate additives and charges to give said elements high flexibility and wear-resistance properties, although without causing damage to the surface on which the guides 10 rest. It is convenient to take into account the wear of the scraping and cleaning elements by conducting suitable maintenance operations.

Figure 4:
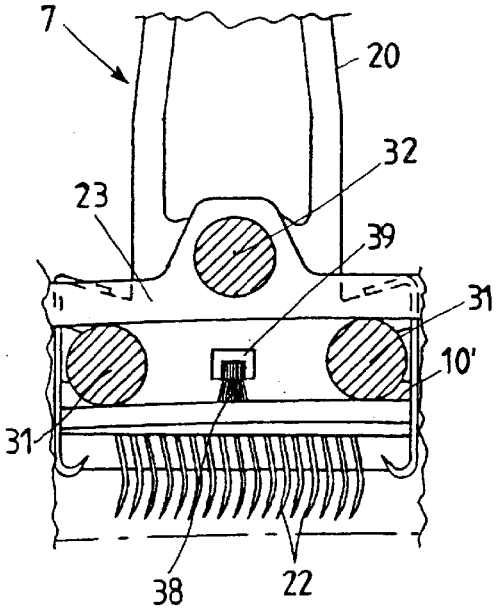
FIGS. 4, 5 and 6 show examples of the different alternatives of shape and structure of the scraping or cleaning elements fitted to the flat.
Figure 5:
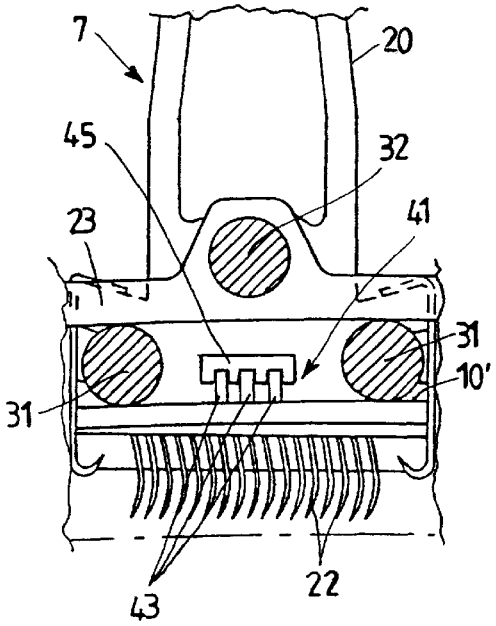

FIGS. 4 and 5 show a plurality of variants of the scraping and cleaning elements to be fitted to the ends of the flat 7. The first variant in FIG. 4 gives an example of the use of a cleaning element composed of one or more bristle brushes 38 fitted to a fixing element 39 of the brush(es) integral with the body of the flat 7, analogously to the supports 36. These brush cleaning elements are efficacious with sweeping action on dusts or incoherent particles deposited on the guides 10. Analogously to the blades 35, the brushes 38 are made to project below the level at which the pins 31 rest, in such a way that their bristles are in efficacious contact on the surface of the guide 10 opposite them, or on its coatings 10'. In the version in FIG. 3, the part of the support 39 protruding from the end of the lower part 21 of the flat 7, on which the brush 38 is fitted, is exemplified shaped with a U-section, that provides a cavity in which to mount the brush elements 38.

A second variant shown in FIG. 4 shows as an example the use of a scraping/cleaning element 41 composed of transversal rows of slim cylinders 43 in an elastomeric or plastic material—fitted radially analogously to the brushes—that through friction exercise a removing action on the impurities stratified on the guides 10. According to a further improvement of the invention this removing element 41 is prepared separately, aligning the elastomeric cylinders 43 on one or more transverse supporting strips, not shown in the figure for simplicity, that are in turn fixed in the cavity of a U-shaped or comb-shaped supporting element 45, for example with adhesives.

Figure 6:
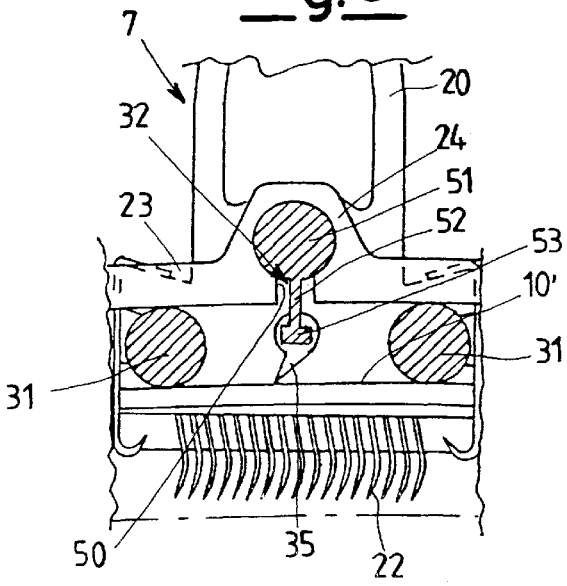

FIG. 6 shows a further variant in which the cleaning or scraping element is fitted to the flat 7, without having recourse to additional supports, such as in the previous examples, but using as a support the body of the coupling pin 32 between the flat 7 and the toothed belt 23, modifying its shape.

As described above, the cylindrical cavity 28 machined in the protrusions 24 of the toothed belt 23 can be made with an open circular section intended to house the coupling element with the flats 7. The use of this downwardly open cylindrical cavity 28 with one opening 50, makes it possible, as shown in FIG. 6, to shape the horizontal pin 32 with a section comprising a larger circular part 51— and intended for insertion into the downwardly opening cavity 28— and a slimmer extension 52 passing through the opening 50. The end 53 of this extension 52 facing towards the face 21 of the flat 7 is shaped to support the scraping/cleaning element that can be a blade 35, as shown in FIG. 6, but also a brush 38, a removing element 41 or of another type.

The different types cleaning elements exemplified above can be advantageously used in conjunction, by inserting in the sequence of the travelling flats of the carding machine, flats provided, for example, with scraping blades 35 of different inclination, material and orientation, with brush elements 38 or with removing elements 41 with cylinders.

According to a further variant of the invention, the scraping/cleaning elements of the different types and combinations of these, can be appropriately fitted to elements in the form of a flat inserted in the travelling flats assembly 7 and circulating with these along their working arc on the carding machine operated by the belts 23. These elements can also be totally devoid of clothing and essentially perform the function of carrier of the scraping/cleaning elements of the guides 10, spaced between the flats provided with clothing. The cleaning device according to the present invention is extremely efficient and flexible in its use with different batches of fibres containing impurities variable both in type and quantity. In fact, it is extremely easy to adjust the cleaning action of the guides 10, varying the number of flats provided with scraping or cleaning elements, or changing the type, material or orientation of these elements, limiting this operation to the flats provided with them. These adaptations can be made very rapidly and in some cases may even be performed with the machine running, replacing the flats involved during their inactive path.

What is claimed is:

1. Device for cleaning guides (10) of a traveling flats assembly (7) in a flat carding machine, in order to eliminate deposits of foreign material on said guides (10), characterized in that the traveling flats assembly (7) is fitted with traveling flats provided with scraping or cleaning elements (35, 38, 41) positioned in contact with surfaces of said guides (10) and on which elements (31) rest and on which said traveling flats assembly is pulled wherein said scraping or cleaning elements protrude below the level on which the elements (31) rest said scraping or cleaning elements (35) being in contact with said surfaces of said guides (10) with a continual grazing motion on the surface on which the elements (31) rest as the traveling flats assembly is pulled wherein said scraping or cleaning elements are composed of a removing element (41) composed of one or more rows of slim, elastomeric or plastic cylinders (43) said elastomeric or plastic cylinders being positioned radially in said removing element (41) to provide a frictional removing action on any impurities stratified on the guides (10).

2. Cleaning device as claimed in claim 1, characterized in that the scraping or cleaning elements (35, 38, 41) are prepared separately and fitted to a support (36, 39, 42, 53), and can be replaced after a set period of use.

3. Cleaning device as claimed in claims 1 or 2, characterized in that said scraping or cleaning elements are composed of blades (35) that protrude below the level on which the elements (31) rest said blades (35) being in contact with said surfaces of said guides (10) with a continual grazing motion on the surface on which the elements (31) rest as the traveling flats assembly is pulled.

4. Cleaning device as claimed in claim 3, characterized in that flexible blades (35) are carried by prismatic elements (36) to fix the blades, to the body of the flat (7), in an intermediate position between the two elements (31).

5. Cleaning device as claimed in claim 1, characterized in that the scraping or cleaning element is composed of one or more bristle brushes (38) fitted to a fixing element (39) of the brushes, said fixing element (39) being integral with the body of the flat (7).

6. Cleaning device as claimed in claim 1, characterized in that the scraping or cleaning elements (35, 38, 41) are fitted to a pin (32) to connect the flat (7) to a drive belt (23), said pin (32) being shaped with a section comprising a part (51), intended for insertion into a cavity (28) of said drive belt (23), said part (51) having an extension (52) that has an end (53) and facing towards the flat (7) and said end (53) being shaped to support the scraping or cleaning element (35, 38, 41).

7. Cleaning device as claimed in claim 1, characterized in that the scraping or cleaning elements (35, 38, 41) are brushes, cylinders or flexible blades which are inserted into the traveling flats assembly (7).

* * * * *